United States Patent [19]

Seltz

[11] Patent Number: 4,519,529

[45] Date of Patent: May 28, 1985

[54] DISPENSING STOPPER

[75] Inventor: Charles L. Seltz, Gurnee, Ill.

[73] Assignee: King-Seeley Thermos Co., Norwich, Conn.

[21] Appl. No.: 253,946

[22] Filed: Apr. 14, 1981

Related U.S. Application Data

[63] Continuation of Ser. No. 087,421, Oct. 22, 1979, abandoned, and a continuation-in-part of Ser. No. 847,901, Nov. 2, 1977, abandoned.

[51] Int. Cl.[3] ..... B67D 3/00

[52] U.S. Cl. ..... 222/484; 222/536

[58] Field of Search ..... 222/484, 485, 533, 534, 222/536, 537, 540

[56] References Cited

U.S. PATENT DOCUMENTS

| | | | |
|---|---|---|---|
| 1,250,081 | 12/1917 | Bennis | 222/536 |
| 1,258,236 | 3/1918 | Menzies | 222/536 |
| 2,883,091 | 4/1959 | Barravecchia | 222/536 |
| 2,979,238 | 4/1961 | Bramming | 222/536 |

*Primary Examiner*—H. Grant Skaggs

*Attorney, Agent, or Firm*—Harness, Dickey & Pierce

[57] ABSTRACT

Two embodiments of a dispensing stopper for bottles or the like having an improved arrangement for supporting the dispensing spout for movement between its open and closed positions. In each embodiment the supporting arrangement utilizes the surface which forms a closure for the pouring spout as a bearing surface to prevent misalignment and insure against leaks. The pouring spout is held in engagement with this combined closure bearing surface by an opposing bearing surface formed on an upper member of the closure. The pouring spout also has a pair of openings that extend through it and which cooperate with openings in the closure. One opening is used for dispensing and the other for venting. The dispensing opening is sized so that a straw may be placed through this opening to sip from the bottle, if desired. The venting opening extends to a lower level in the accompanying bottle than does the dispensing opening to aid in pouring under all conditions. In one embodiment the closure bearing surface and the corresponding surface of the spout are cylindrical segments and in the other embodiment these surfaces are spherical segments.

14 Claims, 7 Drawing Figures

DISPENSING STOPPER

CROSS REFERENCE TO RELATED APPLICATION

This application is a continuation of my application of the same title, Ser. No. 087,421, filed Oct. 22, 1979, now abandoned, which application was a continuation-in-part of my application of the same title, Ser. No. 847,901, filed Nov. 2, 1977, and now abandoned.

BACKGROUND OF THE INVENTION

This invention relates to a dispensing closure for a bottle or the like.

The use of dispensing caps is widely accepted. With such caps a spout is supported by the main body of the cap for movement between a closed position and a dispensing position. In the dispensing position it is possible to remove the contents of the associated botle without removal of the cap. Conventionally these spouts are supported by the cap structure for pivotal movement between their open and closed positions. The cap also has a curved surface through which a discharge passage extends which functions with the spout to form a valve that controls the flow through the spout. With this type of construction it should be obvious that it is essential that the pivotal axis of the closure be accurately disposed relative to the surface which cooperates to form the closure so as to prevent leakage when the elements are in their closed position. Various devices have been proposed for maintaining this relationship including the use of interference fits between the spout and the cap closure surface.

It is, therefore, a principal object of this invention to provide an improved dispensing closure in which the possibilities of leakage are substantially reduced.

It is another object of the invention to provide a dispensing closure in which the surface which forms the closure also forms a bearing surface for the pouring spout.

It has also been proposed to provide dispensing closures of the type previously mentioned in which the dispensing spout may also serve as a straw. Although this type of construction has some advantages, such as permitting sipping from the bottle, the use of a permanent straw is not particularly desirable. It is, however, advantageous if the closure can accommodate a straw if the user so desires.

It is, therefore, a further object of the invention to provide a dispensing closure in which the closure is configured so as to permit the use of a straw to draw contents from the associated bottle, if desired by the user.

Most dispensing closures are intended for use with a squeeze type bottle. In such applications, the contents of the bottle are forced out of the dispensing closure under the pressure applied by the user to the side walls of the container. With such an arrangement, of course, venting of the closure is unnecessary. Dispensing closures, however, may have wide utility and other applications than in connection with squeeze type bottles. In such applications, it is desirable to provide a venting arrangement for the closure.

It is, therefore, a still further object of this invention to provide an improved venting arrangement for a dispensing closure.

SUMMARY OF THE INVENTION

A first feature of this invention is adapted to be embodied in a dispensing closure for a bottle or the like. The closure comprises a lower piece that is adapted to register with the bottle opening and which also defines a curved bearing surface. A delivery passage extends through the bearing surface and terminates in registry with the bottle opening for delivering the bottle contents through the delivery passage. An upper piece is fixed to the lower piece and has a curved bearing surface that faces the curved bearing surface of the lower piece. A pouring spout is positioned at least in part between the upper and lower pieces. The pouring spout has bearing surfaces engaged by the upper and lower piece bearing surfaces for pivotally supporting the pouring spout relative to the pieces between a closed position and a dispensing position. A dispensing passage extends through the pouring spout and terminates at least in part in a portion of the bearing surface of the pouring spout. The pouring spout discharge passage is aligned with the lower piece delivery passage when the pouring spout is in its dispensing position so as to permit dispensing of the contents of the associated bottle without removal of the closure.

Another feature of the invention is adapted to be embodied in a dispensing closure for a bottle or the like. The dispensing closure includes a closure assembly that is adapted to be affixed in sealing relation to a bottle assembly. The closure assembly has a surface through which a delivery passage and a vent passage extend. A pouring spout is supported by the closure assembly for movement between a dispensing position and a closed position. The pouring spout has a discharge passage and a vent passage that extend through it. When the pouring spout is in its discharge position, its discharge and vent passages are aligned with the delivery and vent passages of the closure assembly, respectively. The discharge and delivery passages respectively of the pouring spout and the closure assembly are sized so as to permit the insertion of a straw therethrough for sipping the contents from the bottle when the pouring spout is in its dispensing position.

Still a further feature of the invention is adapted to be embodied in a dispensing closure for a bottle or the like as described in the immediately preceding paragraph. In connection with this feature, however, the vent passage of the closure assembly extends to a lower level in the associated bottle than does the delivery passage for improving venting during pouring.

DETAILED DESCRIPTION OF THE PREFERRED EMBODIMENTS

Figure 1:
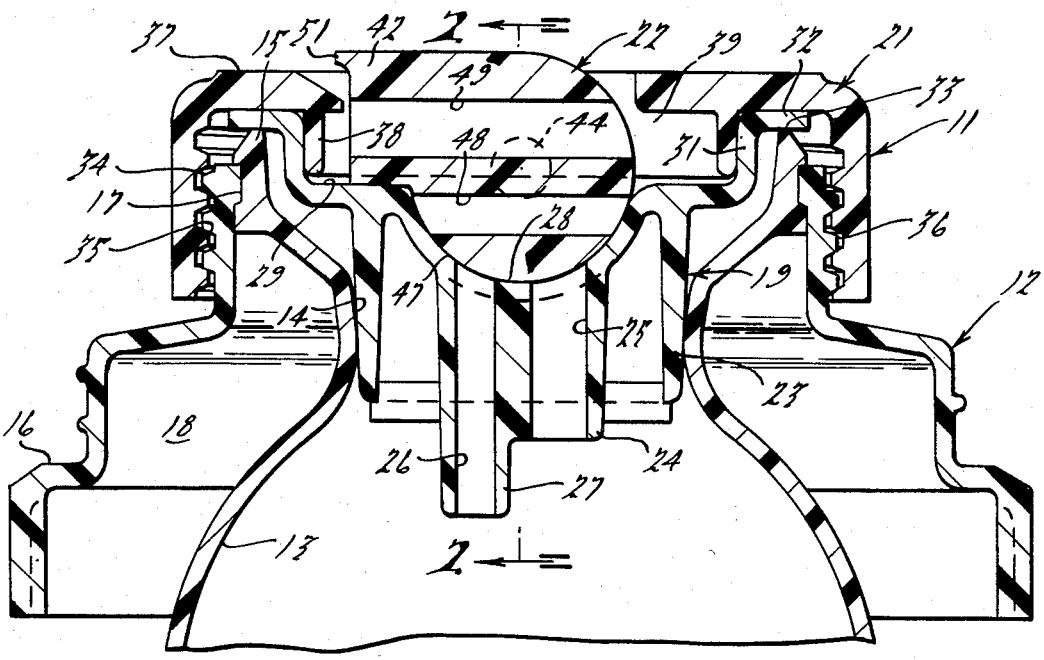
FIG. 1 is a longitudinal cross-sectional view taken through the upper portion of a bottle and pouring spout constructed in accordance with a first embodiment of this invention.
Figure 2:
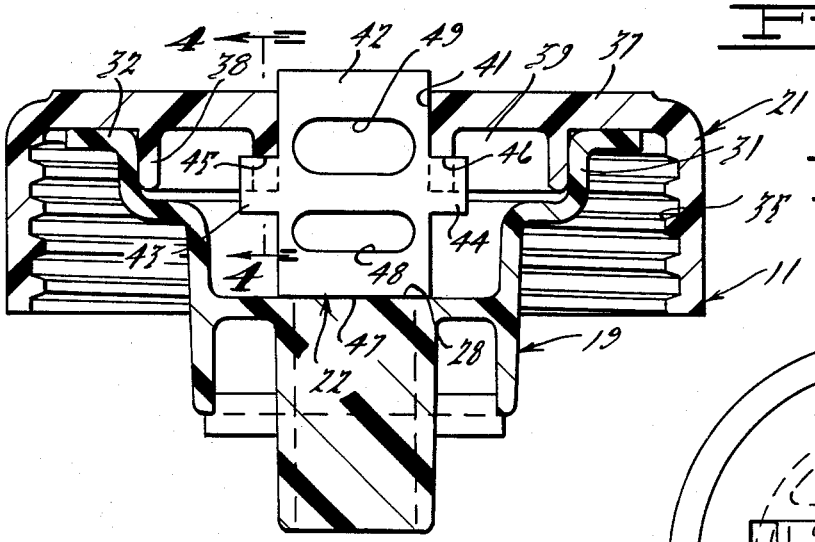
FIG. 2 is a cross-sectional view taken along the line 2—2 of FIG. 1.
Figure 3:
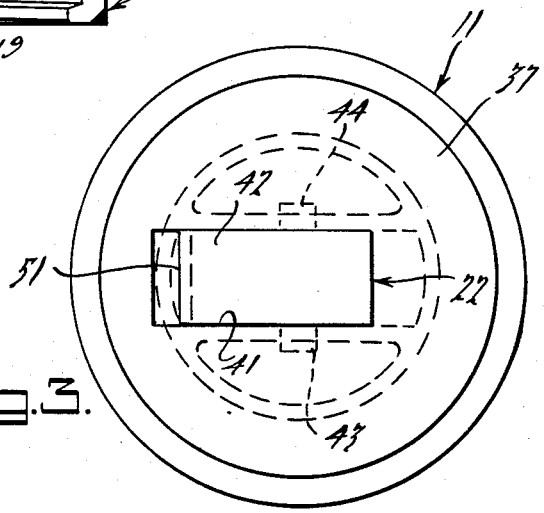
FIG. 3 is a top plan view of the embodiment shown in FIGS. 1 and 2.
Figure 5:
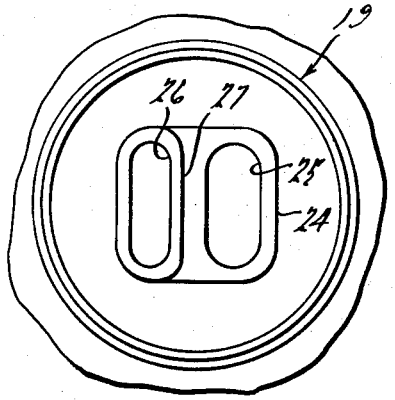
FIG. 5 is a bottom plan view of the embodiment of FIGS. 1 through 4.
Figure 4:
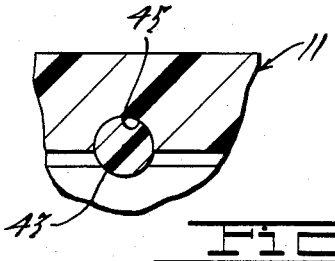
FIG. 4 is a cross-sectional view taken along the line 4—4 of FIG. 2.

Referring first to FIGS. 1 through 5, the reference numeral 11 indicates generally a dispensing closure in accordance with a first embodiment of this invention. The dispensing closure 11 is adapted to cooperate with a bottle or the like, indicated generally by the reference numeral 12 to form a closure and dispensing device for the bottle 12. In the illustrated embodiment, only the upper portion of the bottle 12 is shown. The bottle comprises an inner liner 13 having a restriced neck 14 surrounded by an upstanding flange 15. The outer periphery of the bottle 12 is comprised of a breast piece 16 that is snapped fit into a groove 17 of the flange 15 to form a joint between the liner 13 and a breast piece 16. A gap 18 exists between the outer jacket which includes the breast piece and liner 13. The gap 18 may be filled with any suitable insulating material.

The dispensing closure 11 is of a three-part construction consisting of a lower piece, indicated generally by the reference numeral 19, an upper piece, indicated generally by the reference numeral 12, and a dispensing spout, indicated generally by the reference numeral 22.

The lower piece 19 has a generally tapered nose section 23 that extends into the opening of the liner 13 and which sealingly engages the restricted neck 14. Depending within the nose piece 23 is a projection 24 through which a dispensing passage 25 and a vent opening 26 extend. The projection 24 has an extension 27 through which the lower portion of the vent opening 26 extends for a reason which will become apparent.

On the side opposite the projection 24, the lower piece has an arcuate bearing surface 28 which has generally the shape of a segment of a right circular cylinder. The surface 28 forms a bearing surface, as will be come apparent, and subtends an arc less than 180 degrees.

At its upper end, the bearing surface 28 terminates in an annular surface 29 that is surrounded by a cylindrical upstanding projection 31. The upper end of the projection 31 terminates in an outstanding flange 32 that is adapted to abuttingly engage an annular upper shoulder 33 of the flange 15. This abutment forms a secondary seal between the closure 11 and the bottle 12.

The upper piece 21 has a depending cylindrical skirt 34 which is internally threaded, as at 35. The internal threads 35 mate with external threads 36 formed on the breast piece 16 to affix the closure 11 to the bottle 12.

The upper end of the upper piece 21 terminates in an annular section 37 which extends across and is spaced slightly from the upper end of the lower piece flange 32, for reason to be described.

Depending from the annular section 37 is a cylindrical projection 38 which is snugly received within the lower piece cylindrical portion 31 to form a tight seal between these two pieces in this area. A cavity 39 is formed between the upper piece 21 and the lower piece 19 and in which at least a portion of the pouring spout 22 is received. The central portion of the upper piece 21 is formed with a generally rectangular shape opening 41 which receives a complementary shape portion 42 of the pouring spout 22. Projecting from opposite sides of the portion 42 are a pair of integral trunnions 43 and 44 each having a cylindrical configuration. On opposite sides of the pouring spout 22 and adjacent the opening 41, the upper piece 21 is formed with arcuate bearing surfaces 45 and 46. The surfaces 45 and 46 are cylindrical and of the same radius as the trunnions 43 and 44. The surfaces 45 and 46 subtend an arc less than 360 degrees but something slightly greater than 180 degrees, as is readily apparent from FIG. 4.

When the upper piece 21 is fastened onto the bottle the upper piece bearing surfaces 45 and 46 will force the pouring spout 22 in a generally downward direction. The pouring spout 22 has a generally right cylindrical shaped segment 47 which forms a combined bearing surface and sealing surface. The surface subtends an arc greater than 180 degrees. The rectangular portion 42 of the pouring spout 22 extends from the bearing surface 47. A discharge passage 49 extends through the pouring spout 22 from a location in the bearing portion 47 through the rectangular portion 42 of the pouring spout 22. The passage 49 forms a discharge passage and is of substantially the same size as the delivery passage 25.

In addition to urging the pouring spout 22 into engagement with the lower piece bearing surface 28, the force exerted from the upper piece 21 through the spout 22 to the lower piece 19 causes the flange 32 to sealingly engage the upper shoulder 33 of the bottle 12.

A vent passage 48 extends through the pouring spout 22 on the diametrically opposite side of the discharge passage 49 and terminates at its other end in the bearing surface 47. The passage 49 forms a vent passage and is of substantially the same size and shape as the lower piece vent passage 26.

The drawings illustrate the pouring spout 22 in its closed position. In this position, the opposed ends of the vent passage 48 are sealingly engaged with the lower piece bearing surface 28 and out of registry with the lower piece passage 25 and opening 26. The closed section of the pouring spout sealing and bearing surface 47 will engage and seal opening 26 and passage 25. Thus, an effective closure is formed. The discharge passage 49 of the pouring spout 22 is out of engagement with the lower piece bearing surface 28 and merely extends across the cavity 39.

In order to effect dispensing, an edge 51 of the pouring spout adjacent its rectangular portion 42 is grasped and the pouring spout 22 is pivoted through an angle of about 90 degrees in a clockwise direction as shown in FIG. 1. This rotation occurs about an axis defined by the bearing surfaces 45, 46 and 28, which axis is substantially coincident with the axis of the trunnions 43 and 44. This rotation will bring the pouring spout discharge passage 49 into alignment with the lower piece delivery passage 25 and the pouring spout vent passage 48 into registry with the corresponding vent passage 26 of the lower portion 15. Pouring is then possible. The contents are then poured out of the bottle 12 by turning the bottle to the right as viewed in FIG. 1. In this condition the vent passage 48 and corresponding vent passage 26 of the lower portion will be positioned above the delivery passage 25 and dispensing passage 49 so as to facilitate pouring. The vent passage 26 extends to a lower level in the bottle 12 than does the delivery passage 25. This construction has been found to improve venting and to facilitate pouring in substantially all orientations of the bottle 12. If, rather than pouring the contents from the bottle, one wishes to draw the contents out of the bottle 12 by means of a straw, the discharge and delivery passages 49 and 25 are sized so as to pass a straw.

Figure 6:
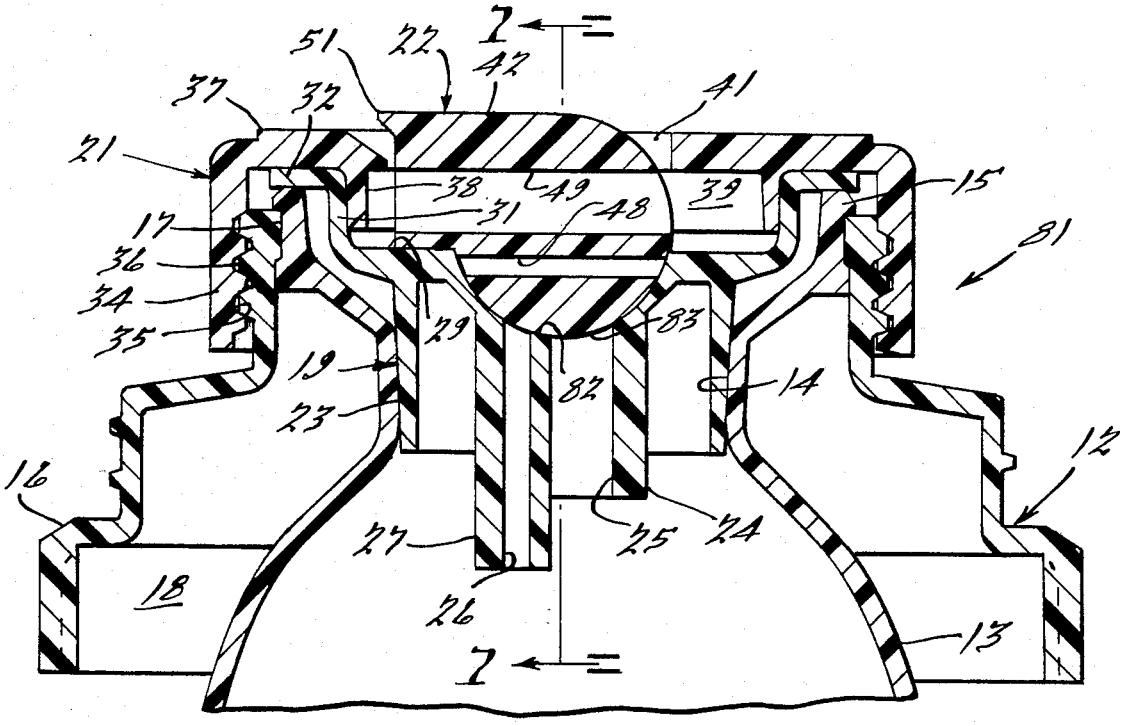
FIG. 6 is a cross-sectional view, in part similar to FIG. 1 showing a further embodiment of the invention.
Figure 7:
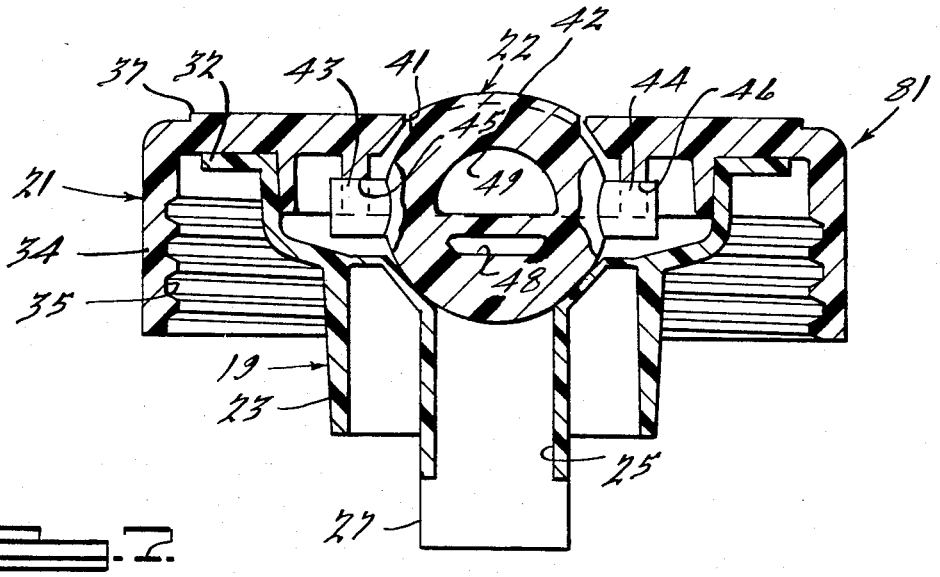
FIG. 7 is a cross-sectional view taken along the line 7—7 of FIG. 6.

Referring now to FIGS. 6 and 7, a second embodiment of the invention is identified generally by the reference numeral 81. In this second embodiment the construction and operation of many of the elements are the same as in the preceding embodiment. Where this is the case, these elements and the components thereof have been identified by the same reference numeral and the description thereof will not be repeated, except where required to explain the construction and operation of this embodiment.

The embodiment of FIGS. 6 and 7 differs only from the embodiment of FIGS. 1 through 5 in the configuration of the bearing surfaces of the lower piece 19 and of the dispensing spout 22. In the preceding embodiment, these surfaces were right circular cylindrical surfaces. In this embodiment, the corresponding surfaces consisting of a bearing surface 82 of the lower piece 19 and a bearing surface 83 of the dispensing spout 22 are spherical segments. The lower piece bearing surface 82 subtends an arc less than 180 degrees. In all other regards and in operaton this embodiment is the same as the previously described embodiment. In some instances it is desirable to use spherical rather than cylindrical bearing surfaces.

In connection with each embodiment, it may be desirable to further improve sealing by providing a raised rib portion in the bearing surface of the lower piece (surface 28 in FIGS. 1 through 5 or surface 82 in FIGS. 6 and 7). This rib may encircle the dispensing passage 25 alone, it may encircle both the dispensing passage 25 and the venting passage 26 or a separate rib may be provided encircling each of these passages.

It should be readily apparent from the foregoing description that the bearing arrangement for the pouring spout in each embodiment is such that its axis is accurately aligned with the axis which forms the closure for the bottle since these bearing surfaces are the same. Therefore, the likelihood of leakage is substantially if not entirely reduced. Furthermore, the construction permits the contents of the bottle to be either poured easily due to the improved venting arrangement or drawn out through a separate straw.

While the above description constitutes preferred embodiments of the invention, it will be appreciated that the invention is susceptible to modification, variation and change without departing from the proper scope or fair meaning of the accompanying claims.

What is claimed is:

1. A dispensing closure for a bottle or the like having an opening comprising a lower piece adapted to register with the bottle opening, said lower piece defining a curved bearing surface, a delivery passage extending through said bearing surface and terminating in registry with the bottle opening for delivery of the bottle contents through said delivery passage, an upper piece fixed relative to said lower piece, said upper piece having a curved surface facing said curved bearing surface of said lower piece, and a pouring spout positioned at least in part between said upper and lower pieces, said pouring spout having a bearing surface engaging said lower piece bearing surface for pivotally supporting said pouring spout relative to said pieces for movement between a closed position and a dispensing position, and a surface engaged by said upper piece surface for urging said bearing surfaces into engagement whereby said bearing surfaces define the pivot axis of said pouring spout, a discharge passage extending through said pouring spout terminating at least in part in a portion of said pouring spout bearing surface, said discharge passage being aligned with said delivery passage when said pouring spout is in its dispensing position, said pouring spout bearing surface having a portion disposed in engagement with said delivery passage when said pouring spout is in its closed position for closing said delivery passage.

2. A dispensing closure for a bottle as set forth in claim 1 wherein the upper piece surface comprises a pair of spaced surfaces disposed on opposite sides of the pouring spout.

3. A dispensing closure for a bottle as set forth in claim 2 wherein the pouring spout has a pair of spaced trunnions defining the portion of the surface of said pouring spout in engagement with the upper piece surface.

4. A dispensing closure for a bottle as set forth in claim 3 wherein the lower piece has a nose portion adapted to sealingly engage the bottle opening, the bearing surface of the lower piece comprising a segment of a right circular cylinder formed at the bottom of a wall portion extending at the upper end of said nose portion and surrounded by a cylindrical upstanding portion of larger diameter.

5. A dispensing closure for a bottle as set forth in claim 4 wherein the upper piece has a cylindrical portion received in the lower portion upstanding cylindrical portion and a depending threaded outer skirt adapted to be threadably received upon the bottle.

6. A dispensing closure for a bottle as set forth in claim 3 wherein the lower piece has a nose portion adapted to sealingly engage the bottle opening, the bearing surface of the lower portion comprising a segment of a sphere formed at the bottom of a wall portion extending at the upper end of the nose portion and surrounded by a cylindrical upstanding portion of larger diameter.

7. A dispensing closure for a bottle as set forth in claim 6 wherein the upper piece has a cylindrical portion received in the lower portion upstanding cylindrical portion and a depending threaded outer skirt adapted to be threadably received upon the bottle.

8. A dispensing closure for a bottle as set forth in claim 7 wherein a vent passage extends through the lower portion and terminates at its bearing surface and further including a corresponding vent passage formed in said pouring spout, said pouring spout vent passage being adapted to be aligned with said lower piece vent passage when said pouring spout is in its discharge position.

9. A dispensing closure for a bottle as set forth in claim 1 wherein each of the bearing surfaces of the lower piece and pouring spout subtend an arc less than 360 degrees.

10. A dispensing closure for a bottle as set forth in claim 9 wherein at least some of the surfaces subtend an arc less than 180 degrees.

11. A dispensing closure for a bottle as set forth in claim 1 wherein a vent passage extends through the lower portion and terminates at its bearing surface and further including a corresponding vent passage formed in said pouring spout, said pouring spout vent passage being adapted to be aligned with said lower piece vent passage when said pouring spout is in its discharge position.

12. A dispensing closure for a bottle as set forth in claim 11 wherein the vent passage of the lower portion extends to a lower level in the associated bottle than does the delivery passage for improving venting during pouring.

13. A dispensing closure for a bottle as set forth in claim 11 wherein at least one of the passages is sized to accept a straw or the like for sipping through the pouring spout when in its discharge position.

14. A dispensing closure for a bottle as set forth in claim 12 wherein the discharge passage is the passage sized to accept the straw.

* * * * *